US006695137B2

(12) United States Patent
Jones et al.

(10) Patent No.: US 6,695,137 B2
(45) Date of Patent: Feb. 24, 2004

(54) BASKET HANDLE

(75) Inventors: Marty Jones, Graham, NC (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 218 days.

(21) Appl. No.: 10/079,727

(22) Filed: Feb. 22, 2002

(65) Prior Publication Data

US 2003/0159950 A1 Aug. 28, 2003

(51) Int. Cl.[7] ..... B65D 75/00
(52) U.S. Cl. ..... 206/166; 206/163
(58) Field of Search ..... 206/147, 162, 206/163, 165, 166, 168, 174, 175, 180, 199, 200, 427

(56) References Cited

U.S. PATENT DOCUMENTS 2,375,631 A * 5/1945 Villard ..... 206/165
2,802,597 A * 8/1957 Davis ..... 206/165
3,107,811 A * 10/1963 Lemon ..... 206/166
3,815,732 A * 6/1974 Klygis et al. ..... 206/163
4,403,690 A * 9/1983 Fischer ..... 206/163
5,975,287 A * 11/1999 Negelen ..... 206/168

* cited by examiner

*Primary Examiner*—Luan K. Bui

(57) ABSTRACT

A wrap-around neck through the top carrier with a handle that can retracted into the interior of the carrier for stacking one carrier on top of another and which can be easily extended for carrying. The retractabilty and extension of the handle is facilitated by having a flexing panel attached to the handle panel by a fold line which in turn is attached to the top panel by fold line with a fold line between the handle panel and the flexing panel being approximately midway between the apertures in the top panel and the hand aperture in the handle panel. There also a fold line adjacent the apertures for the bottles.

10 Claims, 6 Drawing Sheets

BASKET HANDLE

FIELD OF THE INVENTION

The present invention relates generally to a basket carrier of the wrap around neck through the top type with a handle that can be positioned entirely below the top of the bottles when loaded and extended above the bottle tops for carrying by the consumer. When the handle is in the down or retracted position, the carriers loaded with bottles can be stacked one upon the other. When the carrier with loaded bottles is removed from the store shelf, the consumer can pull the handle up above the top of the bottles in order to carry the carrier.

BACKGROUND OF THE INVENTION

Basket carriers for carrying a plurality of bottles are well known in the art. Many of these carriers have a handle that extends above the top of the bottles being carried. This is a fine arrangement as far as the carrying of the bottles, but it does not permit the basket carriers loaded with bottles to be stacked one on top of another. Many bottle carriers have handles that do not extend above the tops of the bottles and, hence can be easily stacked one on top of another. However, the carriers where the aperture for the person's hand in the handle is below the top of the bottles are not easy to carry. A person's carrying hand frequently rubs against the caps of the bottles and may be scratched to the consumer's annoyance.

There are basket carriers that have fold down handles that can be stacked when loaded with bottles one on top of another, but these handle structures tend to be complicated and are not easily manipulated by the consumer. Furthermore, these handle structures use extra paperboard and hence are not too economical. It would be desirable to have a basket style carrier with a handle that can be easily placed below the top of the bottles in a retracted position when loaded with bottles and be easily extended by the consumer when removed from the shelf.

SUMMARY OF THE INVENTION

It is the object of this invention to develop a basket style carrier of the wrap around neck through the top type for bottles that can be easily stacked which necessitates that the handle not extend above the top of the bottles when loaded. It is a further object to develop a basket style carrier in which the consumer can extend the handle above the top of the bottles for easy carrying. These objects have been obtained with a wrap around carrier with a neck through the top opening for necks of bottles which is constructed so as to have a flexible handle that can be pushed into a retracted position for the stacking of carriers one of top of the another and can be easily pulled into the extended carrying position by the consumer. This object is achieved by having at least two (2) score lines in the paperboard between the aperture for the hand and the aperture for the bottle neck with the score line nearest the hand aperture being approximately midway between the apertures for the bottle neck and the aperture for the hand and then being other score line being adjacent to the apertures for the bottle necks. The use of two (2) score lines in these approximate positions facilitates flexing the handle into the retracted position. In addition, the bottle neck apertures can be made elliptical and slightly larger than the bottle necks to permit the slight movement of the bottles necessary during the retraction of the handle. The handle may be held in the retracted position by the bottles in each row acting like a wedge to hold the handle in the retracted position.

The carriers of this invention are formed from a single blank of paperboard and are folded and glued together to form collapsed carrier. This carrier can be formed from a single rectangular blank of paperboard of a thin caliber, which increases efficiency and reduces waste.

When the wrap around carrier of this invention is filled with bottles on the packaging machine, the handle is pushed into the retracted position, which facilitates stacking the carriers on top of each other. The handle can be readily extended for carrying by the consumer.

These and other objects, features, and advantages of the present invention will become more apparent upon reading the following specification in conjunction with the accompanying drawings and figures.

DETAILED DESCRIPTION OF THE PREFEERED EMBODIMENTS

The present invention is intended primarily for use with wrap-around carriers containing bottles of the types to contain soft drinks, beer and the like. A typical example of such a bottle has a generally cylindrical body with an upper portion and a bottom, a tapering shoulder smoothly continuous with the portion of the body, and a neck formed on the shoulder having a smaller diameter than the body. This conventional bottle B also has a neck flange projecting outwardly from the neck, and a cap attached to the upper end of the neck flange.

The wrap-around carriers of this invention have apertures in the upper sidewalls through which the neck of the bottles extend and has a carrying handle that extends above the tops of the bottles.

Wrap Around Carrier with a 2-Ply Flexible Carrying Handle

Figure 1:
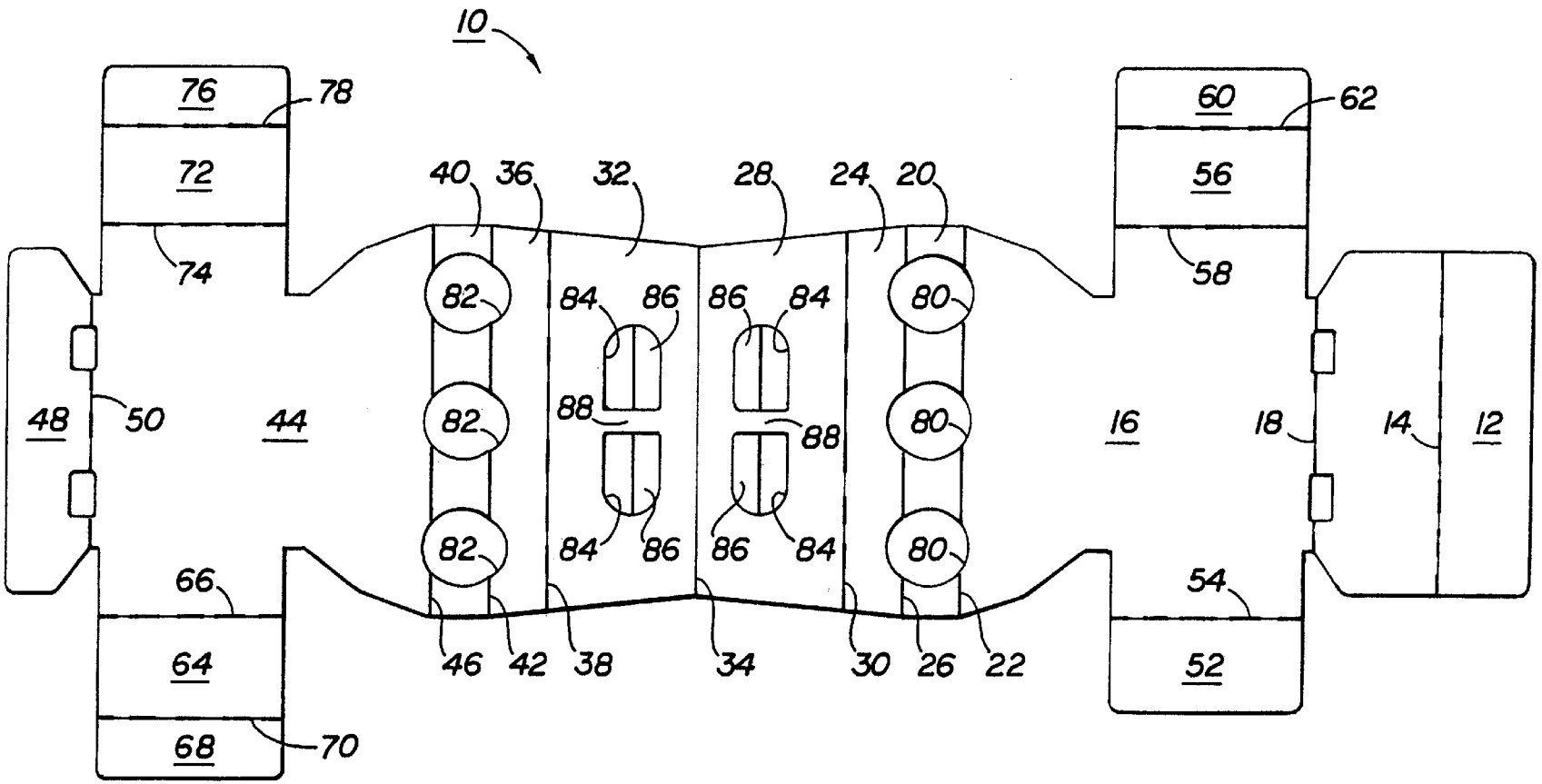
FIG. 1 is a plan view of a blank, which incorporates the flexible carrying handle of the present invention.

The blank for forming the carrier with a 2-ply flexible carrying handle is illustrated in FIG. 1.

This blank 10 is designed to contain six beverage bottles B arranged in two rows of three each. The blank 10 is formed from a foldable sheet of material, such as paperboard. The blank 10 has a bottom panel 12 with a fold line 14. The bottom panel 12 is connected to a lower side wall 16 by fold line by fold line 18, which in turn is connected to an top panel 20 by fold line 22, which is connected to flexing panel 24 by fold line 26. Flexing panel 24 is connected to handle panel 28 by fold line 30, which in turn is connected to identical handle panel 32 by fold line 34, which in turn is connected to flexing panel 36 by fold line 38. Flexing panel 36 is connected to top panel 40 by fold line 42 and connected to lower sidewall 44 by fold line 46. The lower sidewall 44 is connected bottom flap 48 by fold line 50.

Lower side panel 16 is connected to end panel 52 by fold line 54 and connected to end panel 56 by fold line 58. The end panel 56 is connected to glue flaps 60 by fold line 62. Similarly, lower sidewall 44 is connected to end panel 64 by fold line 66, which in turn is connected to glue flaps 68 by fold line 70. In a like fashion, end panel 72 is connected to lower sidewall 44 by fold line 74. End panel 72 is connected to glue flaps 76 by fold line 78.

This carrier has bottle neck apertures 80 positioned between fold lines 22 and 26 and bottle neck apertures 82 positioned between fold lines 42 and 46.

The handle panels 28 and 32 have hand apertures 84 formed from flaps 86 which can be bent backward to the inside of the handle panel for ease of carrying and strengthening the handle panel. A bridge 88 may be formed between two (2) ends of the hand apertures 84 to further strengthen the handle panel since the handle is only a 2-ply structure.

It will be understood by those in the art that the preferable carrier is symmetrical about a horizontal line of bisection, as viewed from FIG. 1. This symmetry aids in the efficient production of the present carrier. The carrier need not have such symmetry, although it is preferred. As shown, the blank 10 are rectangular and include straight edges, which makes for an efficient layout of the blank in a web from which the blanks are cut.

The carrier of this embodiment is formed from the blank of FIG. 1 by first gluing end panels 52, 56, 64 and 72 together respectively. The glue flaps 60, 68, and 76 can be glued or simply left free and pushed between adjacent bottles. The top panels 20 and 40 of the carrier are moved so that a portion of the necks of a group of bottles extend through apertures 80 and 82. The blank 10 is folded around a group of bottles. Bottom flap 48 is glued to bottom panel 12 to finish the carrier.

Figure 2:
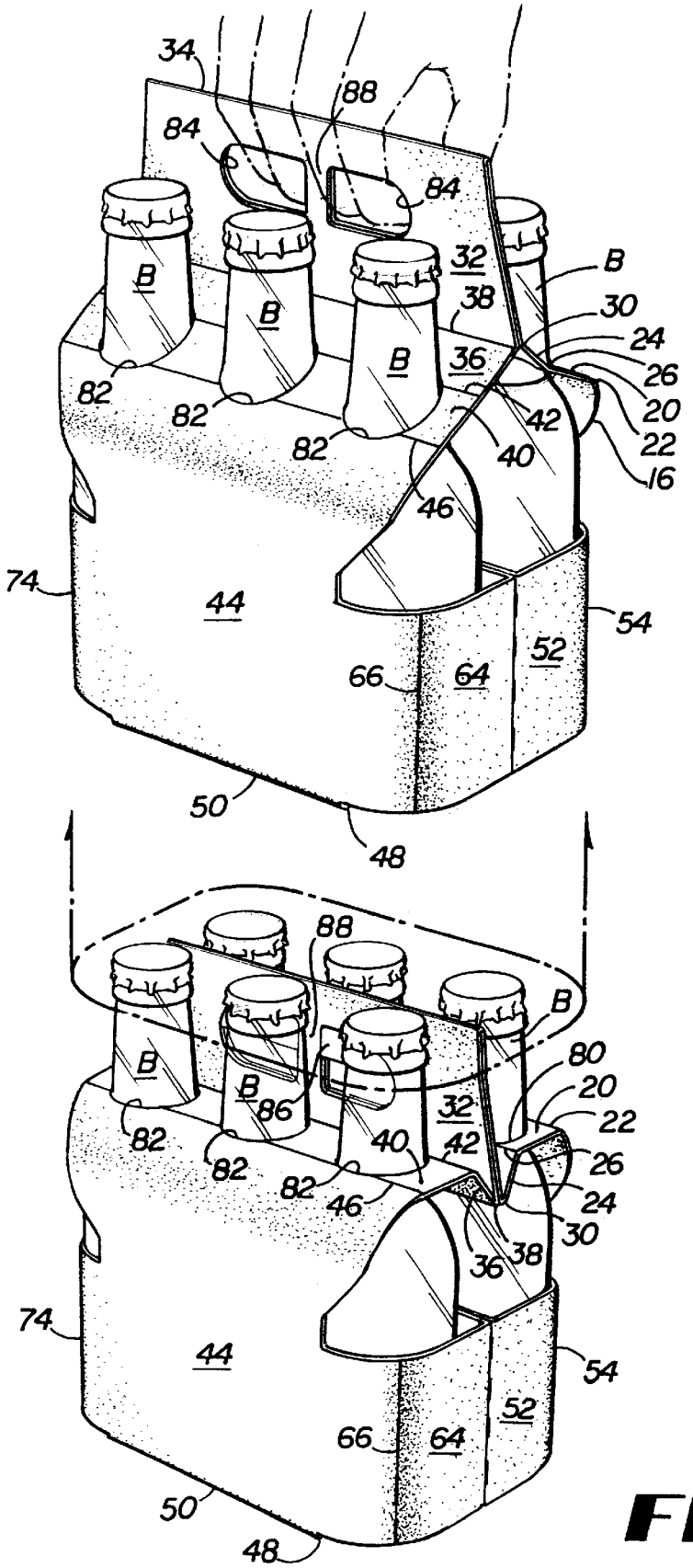
FIG. 2 is a perspective view of a carrier formed from the blank of FIG. 1, which has been erected and loaded with bottles.
Figure 3:
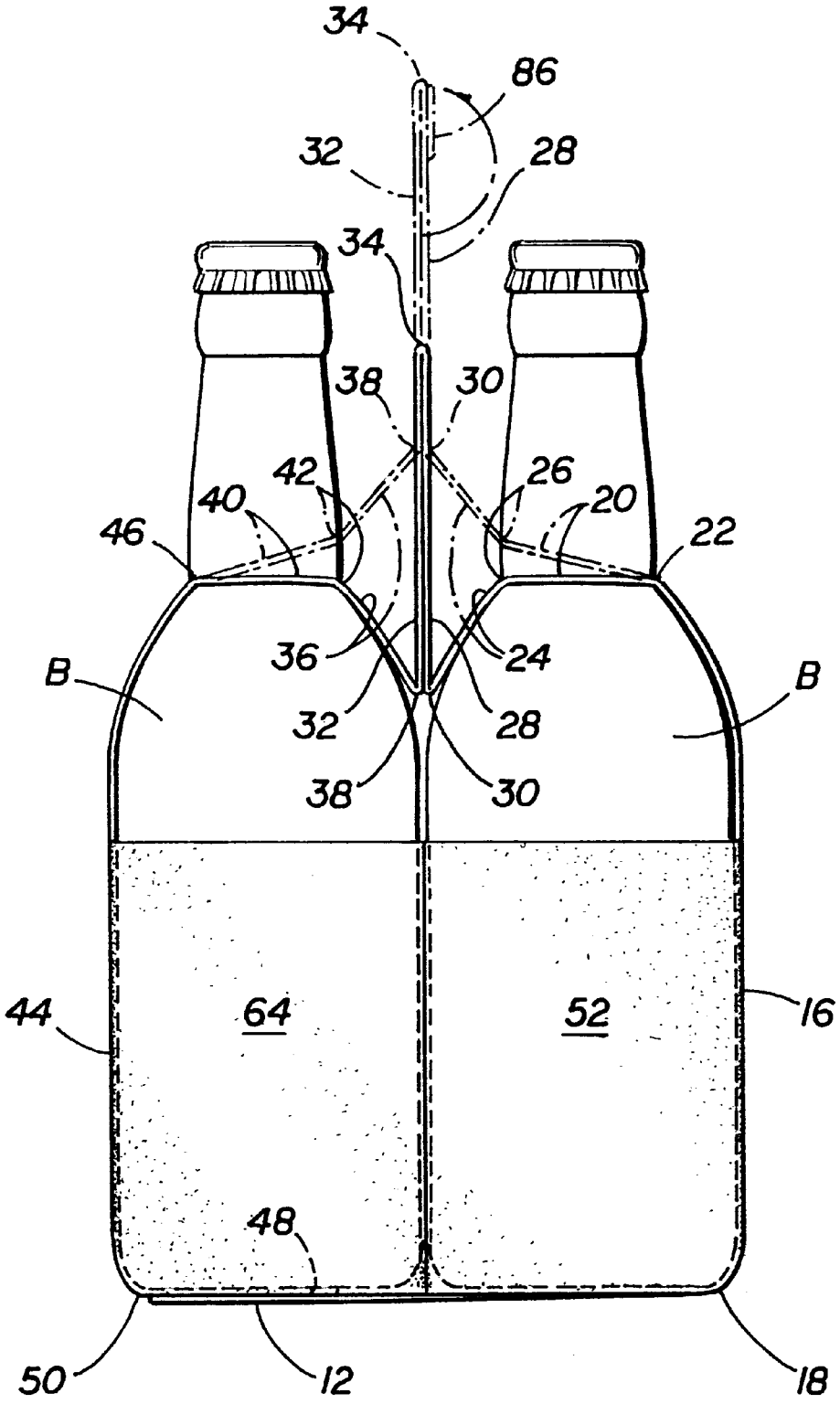
FIG. 3 is an end view of FIG. 2.

The packaging machine has a bar that pushes handle panels 28 and 32 downwardly along fold line 34 into the retracted position. This is feasible to do because fold line 30 is located at approximately the midpoint between bottle neck apertures 80 and the nearest hand apertures 84. Similarly, fold line 38 is located at approximately the midpoint between bottle neck apertures 82 and the nearest hand apertures 84. Flexing panels 24 and 36 flex during this operation to permit the handle to be pushed into the fully retracted position. Depending of the bottle size and the configuration of the carrier, more than one fold line may be necessary between the bottle neck apertures and the nearest hand apertures to permit the desired degree of flexing. The bottle neck apertures 80 and 82 may be elliptical in shape and slightly larger than the bottle necks to permit the flexing of the handle and into the retracted position and into the extended position. The greater length of the bottle neck apertures is between the flexing panel and lower side wall to permit movement of the bottle necks during retraction and extension of the handle. The handle panels 28 and 32 may be held in the retracted position by virtue of adjacent bottles forming a wedge as illustrated in FIG. 3 and exerting pressure against the hand panels 28 and 32. It acts like an over center spring with the flexable paperboard serving as a spring. It may assist in keeping the handle panels in the retracted position during shipment and stacking of the carriers on top of each other. When the handle panel is in the retracted position, this carrier with bottles can be stacked one on top of the other as shown in FIG. 2. When the consumer removes a loaded carrier, he or she can easily extend the handle panel into the extended position for carrying as shown in FIG. 2. This is feasible because of the flexibility of flexing panels 24 and 36 in the presence of fold line 30 and 38 at a mid point between the bottle neck apertures and the nearest hand aperture.

Bottle Carrier with a 4-Ply Handle

Figure 4:
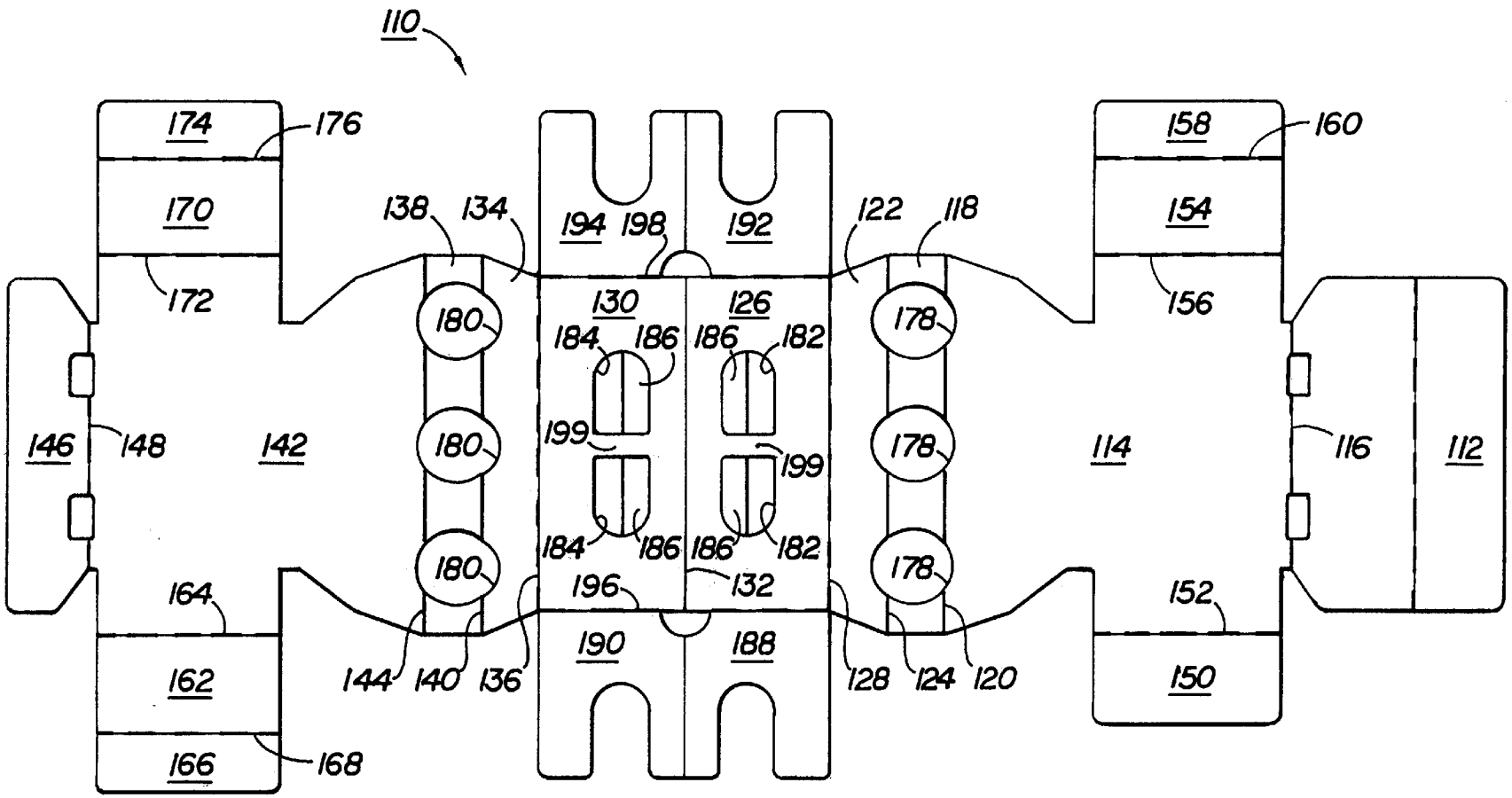
FIG. 4 is a plan view of a blank of a different embodiment, which incorporates the flexible carrying handle of the present invention.

The blank for forming the carrier of this embodiment is illustrated in FIG. 4. This blank 110 is designed to contain six (6) beverage bottles B arranged in two (2) rows of three (3) each. The blank 110 is formed from a foldable sheet of material such as, paperboard. The bottom panel 112 is connected to the lower side wall 114 by fold line 116, which is connected to the top panel 118 by fold line 120. The top panel 118 is connected to flexing panel 122 by fold line 124, which in turn is connected to handle panel 126 by fold line 128. Handle panel 126 is connected to corresponding handle panel 130 by fold line 132, which is connected to flexing panel 134 by fold line 136 and in turn connected to top panel 138 by fold line 140. Top panel 138 is connected to lower side wall 142 by fold line 144, which in turn is connected to bottom flap 146 by fold line 148. Lower side wall 114 is connected to end panel 150 by fold line 152 and to end panel 154 by fold line 156, which is in turn connected to glued flaps 158 by fold line 160. Lower side wall 142 is connected to end panel 162 by fold line 164, which is in turn connected to glued flaps 166 by fold line 168. Lower side wall 142 is connected to end panel 170 by fold line 172, which in turn is connected to glue flaps 174 by fold line 176. Top panels 118 and 138 have bottle neck apertures 178 and 180 respectively. Handle panels 126 and 130 have hand apertures 182 and 184 respectively in which flaps 186 are located. These flaps may be folded back in forming the carrier to cushion the hand and the strengthen the handle panel. Attached to the ends of handle panels 126 and 130 are reinforcing panels 188, 190, 192 and 194. Reinforcing panels 192 and 190 are attached to handle panels 126 and 130 respectively by fold line 196. Reinforcing panels 192 and 194 are attached to handle panels 126 and 130 respectively by fold line 198.

This carrier is wrapped around a grouping of bottles much the same way as the carrier embodiment described supra. End panels 150 and 162 are glued together with glue flap 166 remaining free to be extended between adjacent bottles. In a similar fashion, end flaps 154 and 170 are glued together with glue flaps 158 and 174 being allowed to be free to be inserted between bottles when the carrier is loaded. The blank is then 110 is the draped over a grouping of bottles with the bottle neck apertures 176 and 180 being placed around the necks of the group of bottles. Reinforcing panels 188, 190, 192 and 194 are folded inwardly in juxtaposition to the inside of handle panels 126 and 130 and handle flap 186 may be folded inwardly over reinforcing panels 188, 190, 192 and 194. A bridge 199 may be included between hand apertures 182 and 184 to provide additional support. The handle panels 126 and 130 are pushed downwardly by a bar on the packaging machine on fold line 132.
This handle may be held in the retracted position by the wedge effect of the bottle that is illustrated in FIG. 3 and explained supra.

Carrier with a 4-Ply Handle Die Cut in a Side-by-Side Layout

Figure 5:
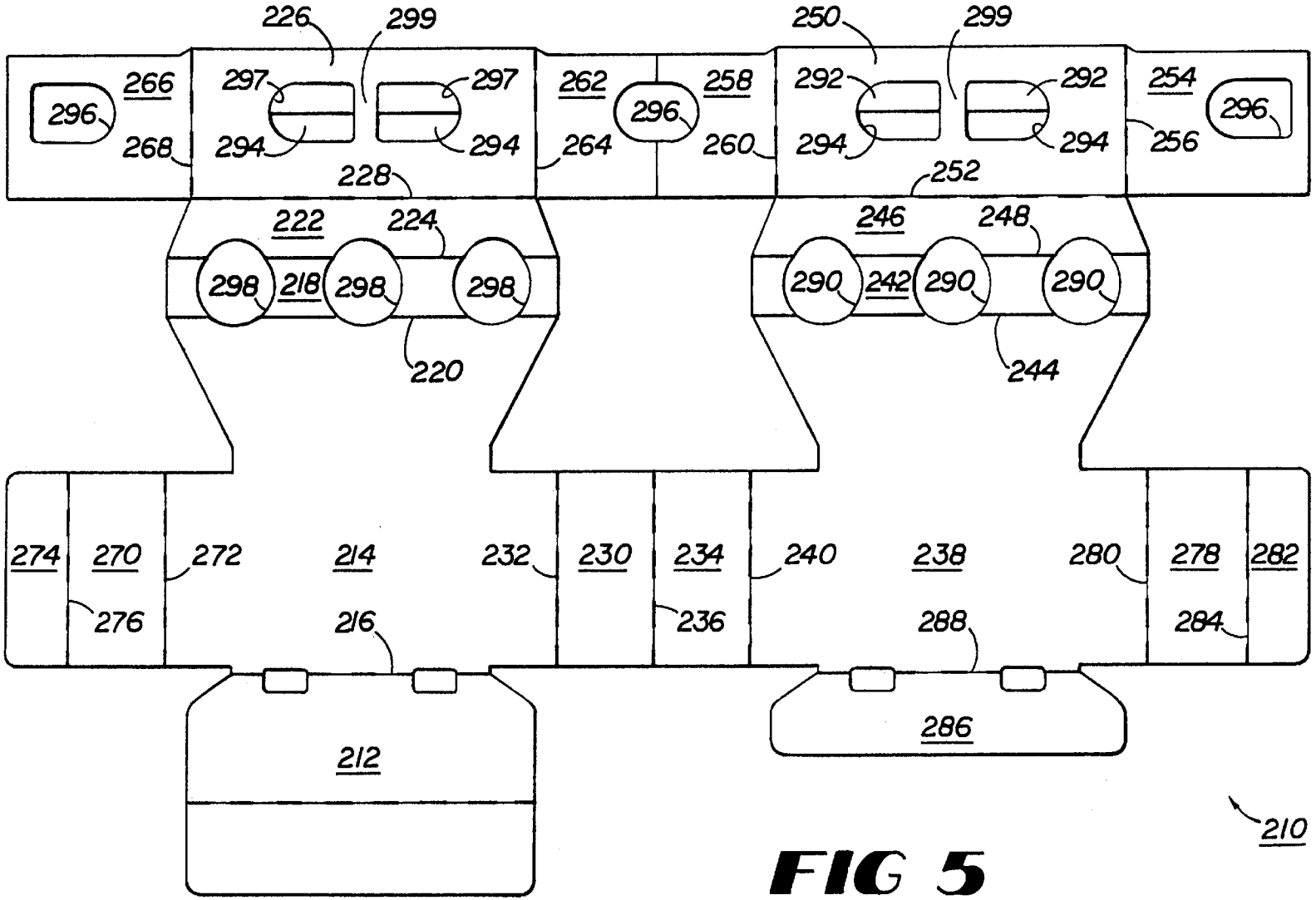
FIG. 5 is a perspective view of a blank of another embodiment, which incorporates the flexible carrying handle of this invention.

The blank for forming the carrier in this embodiment is illustrated in FIG. 5. The blank is designed to contain six (6)

beverage bottles B arranged in two (2) rows of three (3) each. This blank is laid out for being die cut in a side-by-side arrangement. The blank has a bottom panel 212, which is foldable connected to a lower side wall 214 by fold line 216 which is foldable connected to top panel 218 by fold line 220 which is connected to flexing panel 222 by fold line 224, which in turn is connected to handle panel 226 by fold line 228.

Lower side wall 214 is connected to end panel 230 by fold line 232 which is connected to end panel 234 by fold line 236 which in turn is connected to lower side wall 238 by fold line 240. Lower side wall 238 is connected to top panel 242 by fold line 244 which is connected to flexing panel 246 by fold line 248 and connected to handle panel 250 by fold line 252. Handle panel 250 is connected to reinforcing panels 254 and 258 by fold lines 256 and 260 respectively. Similarly, handle panel 226 is connected to reinforcing panel 262 by fold line 264 and to reinforcing panel 266 by fold line 268. Lower side wall 214 is connected to end panel 270 by fold line 272, which is connected to glued flaps 274 by fold line 276. In a similar fashion, lower side wall 238 is connected to end panel 278 by fold line 280 which is connected to glued flaps 282 by fold line 284. Lower side wall 238 is connected to bottom flap 286 by fold line 288.

This carrier has bottle neck apertures 290 between fold lines 244 and 248 in the top panel 242. Hand apertures 292 are formed in handle panel 250. These hand apertures may have hand flaps 294, which fold backward to cushion the hand and strengthen the hand apertures. The reinforcing panels 254, 258, 262 and 266 may have hand apertures 296. Hand aperture 297 is formed in handle panel 226 which may also have hand flaps 294. Bottle neck apertures 298 are formed in top panel 218 between fold lines 220 and 224. The hand apertures 292 and 297 may be divided into two (2) parts with a bridge 299 in between to provide additional support.

This carrier is formed by gluing end panels 270 and 278 together. Glue flaps 274 and 282 can be left free and slid between adjacent bottles in the forming of the carrier. Reinforcing panels 254, 258, 262 and 266 are folded inwardly in juxtaposition to the respective handle panel 226 and 250 and the resulting structures glued together to form the handle of the carrier. The hand flaps 294 may be folded back against the reinforcing panels.

This carrier is loaded with bottles by arranging a group of six (6) bottles and draping the blank 210 over the bottles and inserting the necks of the bottles stronger by bottle neck apertures 290 and 298. The bottom flap 286 is glued to the bottom panel 212. After the carrier is loaded, the handle is pushed down into the retracted position. The handle may be maintained in the retracted position by virtue of the wedge effect described in connection with FIG. 3 supra.

2-Ply Carrier with Side-by-Side Layout

Figure 6:
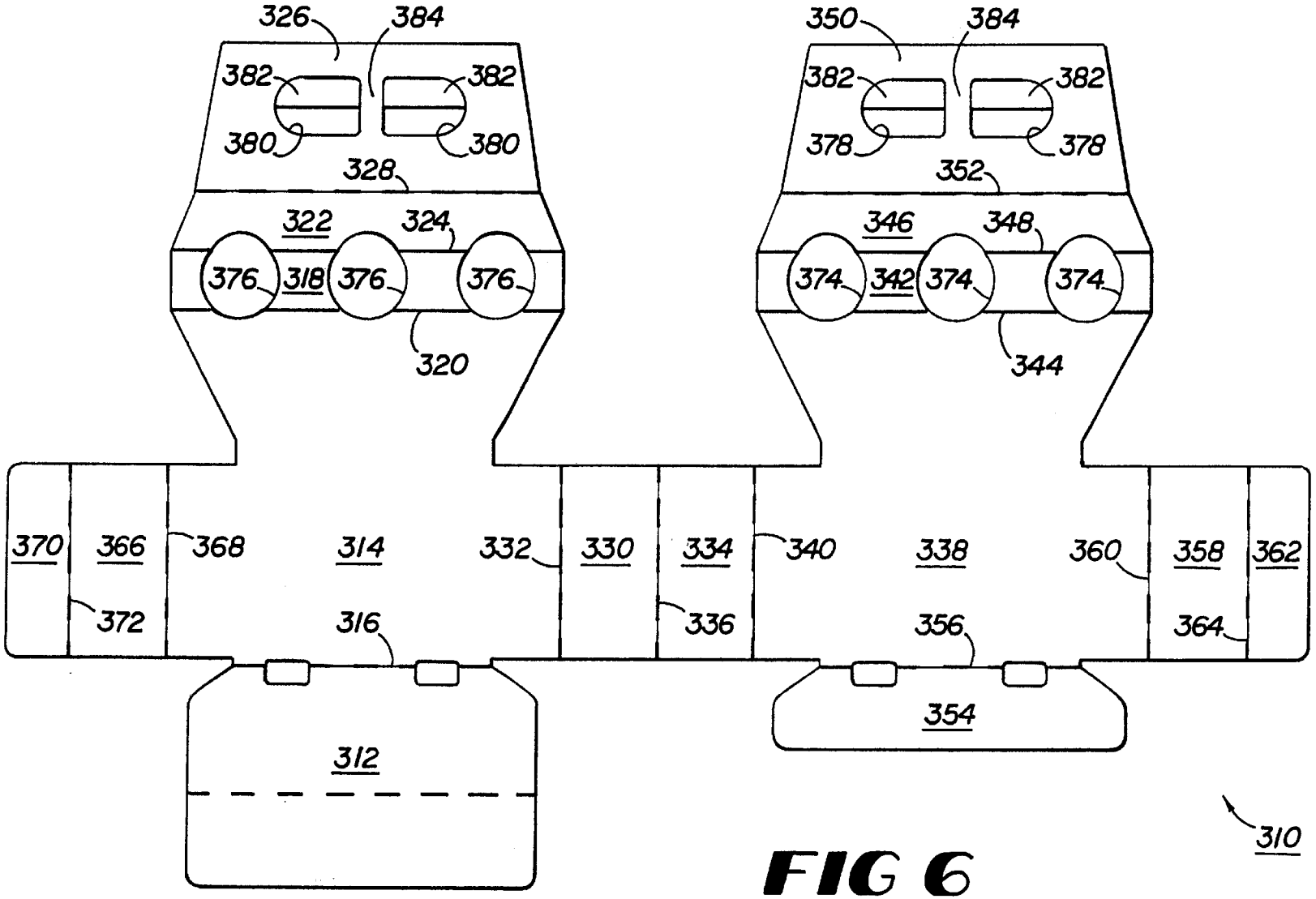
FIG. 6 is a plan view of a blank of another embodiment of this invention, which incorporates the flexible carrying handle of this invention.

The blank for forming the carrier of this embodiment is illustrated in FIG. 6. This blank 310 is designed to contain six (6) beverage bottles B arranged in two (2) rows of three (3) each. The blank 310 is formed from a foldable sheet of material, such as paperboard. The blank has a bottom panel 312 which is connected to lower side wall 314 by fold line 316, which is connected to top panel 318 by fold line 320, and in turn is connected to flexing panel 322 by fold line 324 and finally to handle panel 326 by fold line 328. This portion of the blank 310 is connected through lower side wall 314 to end panel 330 by fold line 332 and in turn connected to end panel 334 by fold line 336 which is connected to the other part of the blank by lower side wall 338 through fold line 340. Lower side wall 338 is connected to top panel 342 by fold line 344, and in turn connected to flexing panel 346 by fold line 348, and finally to handle panel 350 by fold line 352. Lower side wall 338 is connected to bottom flap 354 by fold line 356 and lower side wall is connected to end panel 358 by fold line 356 and in turn connected to glued flaps 362 by fold line 364. Lower side panel 314 is connected to end panel 366 by fold line 368 and in turn connected to divider panel 370 by fold line 372.

The carrier has bottle neck apertures 374 and 376 located in the top panels 318 and 342 between fold lines 320,324, 344 and 348 respectively. The carrier has hand apertures 378 and 380 formed in top panels 326 and 350 respectively. These hand apertures 378 and 380 may have hand flaps 382 to cushion the hand and strengthen the handle structure. These hand apertures 378 and 380 may be divided into two (2) parts by bridge 384.

This carrier is formed by gluing end panels 358 and 366 together and allowing glue flaps 362 and 370 to be free so they can be easily inserted between adjacent bottles. Handle panels 326 and 350 are glued together. This carrier is draped over bottles with the bottle neck apertures 374 and 376 inserted over the necks of the bottles. The bottom flap 354 is glued to bottom panel 312. The hand flaps 382 may be bent inward to strengthen the carrier. After loading, the handle structure is pushed downwardly into the retracted position and may be held in that position by the wedge effect demonstrated in FIG. 3 supra.

While all the above embodiments have been described as being glued cartons, it should be understood that the bottom panel and bottom flap could be locked together by a conventional locking mechanism.

While the invention has been disclosed in its preferred forms, it will be apparent to those skilled in the art that many modifications, additions, and deletions can be made therein without departing from the spirit and scope of the invention and its equivalents as set forth in the following claims.

Unique Features of this Invention

This invention provides a handle that can be easily retracted so that it is entirely below the top of the bottles in order to facilitate stacking the carrier when loaded with bottles, but which can be easily extended for carrying by the consumer. The retraction of the handle of the carrier is facilitated by having a flexing panel attached to the handle panel and with a fold line between the flexing panel and the handle panel and the handle panel that is approximately midway between hand apertures and the bottle neck apertures in the top panel. There is also a fold line between the top panel and the flexing panel adjacent to the bottle neck apertures. The neck apertures may be elliptical toward the handle panel to facilitate movement of the bottles during the retraction and extension of the handle. These features permit the necessary flexing to permit the handle to be retracted and easily extended.

We claim:

1. A wrap-around neck through the top carrier for containing a plurality of bottles in two (2) rows, the carrier comprising:

a) a bottom with two (2) sides, with a side panel attached to each side of the bottom, with each side wall having an upper side which is attached to a top panel by a fold line, which in turn is attached to a flexing panel by a fold line, which is in turn is attached to a handle panel by at least one fold line, the side panels having ends which are attached to end panels; and b) the carrier having a hand aperture in each handle panel for carrying, and bottle neck apertures in the top panels through which the necks of the bottles can extend, with at least one fold line between each flexing panel and each handle panel being located approximately midway between the bottle neck apertures and the nearest hand apertures so that the flexing panel and fold line between each handle panel and adjoining flexing panel provide the necessary degree of flexibility so that the handle panels can be pushed downwardly into a retracted position after this carrier is loaded with bottles by a packaging machine so carriers can be stacked one on another, said flexing panels and fold lines between the flexing panel and adjoining handle panel having sufficient flexibility so that the handle panels can be easily extended into the carrying position when the carrier loaded with bottles is picked up.

2. The carrier of claim 1 in which there is only one fold line between each handle panel and adjoining flexing panel.

3. The carrier of claim 1 in which the handle panels in the retracted position is entirely below the top of the bottles.

4. The carrier in claim 1 in which the fold line between each top panel and flexing panel intersect the bottle neck apertures in the top panel.

5. The carrier of claim 1 in which there is sufficient force exerted by the bottles and carrier to hold the handle panels and flexing panels in the retracted position during the movement of the carrier when loaded with bottles.

6. The bottle carrier of claim 2 in which the fold lines between each flexing panel and each handle panel which has a top, is in a position far enough below the top of the handle panel into interior of the carrier so that the top of each handle panel is below the top of the bottles when the handle panels are in the retracted position.

7. The bottle carrier of claim 1 in which the bottle neck apertures are elliptical and slightly larger than the necks of the bottles the apertures are designed to engage, with the greater length of the elliptical configuration being in the direction of the handle panel.

8. In a wrap-around neck through the top carrier, the improvement being a pair of handle panels with hand apertures, where the handle panels can be pushed into a retracted position when loaded with bottles by virtue of having a top panel with the bottle neck apertures which is connected to a flexing panel by fold line which in turn is connected to a handle panel by a fold line that is approximately midway between the adjoining hand aperture and bottle neck apertures so that the handle panels can be pushed downward into the retracted position for stacking of carriers loaded with bottles and the handle panels can be easily extended for carrying.

9. The bottle carrier of claim 8 in which the bottle neck apertures are elliptical and slightly larger than the necks of the bottles the apertures are designed to engage, with the greater length of the elliptical configuration being in the direction of the handle panel.

10. A retractable handle for a wrap-around neck through the top carrier wherein the handle comprises:

a) two (2) handle panels in juxtaposition to each other with apertures for the hand, each handle panel having a bottom which is attached to a flexing panel by a fold line which in turn is attached to top panel by a fold line, the top panel having apertures for the necks of the bottles, the fold line between the flexing panel and handle panel being approximately midway between the hand aperture and the apertures for the necks of the bottle so that the flexing panel and fold line between the flexing panel and the handle panel permit the handle to be retracted when the carrier is loaded with bottles for stacking one carrier on top of another and easily extended for carrying the carrier.

* * * * *